US005950647A

United States Patent [19]

Usher

[11] Patent Number: 5,950,647

[45] Date of Patent: Sep. 14, 1999

[54] PARTS WASHING APPARATUS

[75] Inventor: Michael D. Usher, Laguna Niguel, Calif.

[73] Assignee: Usher Oil Company, Detroit, Mich.

[21] Appl. No.: 09/195,289

[22] Filed: Nov. 18, 1998

[51] Int. Cl.[6] ..... B08B 3/02

[52] U.S. Cl. ..... 134/111; 134/201

[58] Field of Search ..... 134/107, 201, 134/111; 312/228; 68/3 R; 206/446; 215/398, 395; 248/154; 220/628, 631; 4/625, 626, 166

[56] References Cited

U.S. PATENT DOCUMENTS

| | | | |
|---|---|---|---|
| 455,094 | 6/1891 | Bruso . | |
| 565,371 | 8/1896 | Stadelman . | |
| 2,985,310 | 5/1961 | Norris | 211/74 |
| 3,224,595 | 12/1965 | Sherley | 211/83 |
| 3,679,161 | 7/1972 | Husting | 248/154 |
| 3,983,583 | 10/1976 | Herman | 4/167 |
| 4,127,211 | 11/1978 | Zerbey | 220/212 |
| 4,620,685 | 11/1986 | Taguchi | 248/349 |
| 4,807,777 | 2/1989 | Berwald | 220/23.83 |
| 4,848,711 | 7/1989 | Mandel | 248/154 |
| 5,143,338 | 9/1992 | Eberlin | 248/313 |
| 5,182,822 | 2/1993 | Cyr | 4/625 |
| 5,305,481 | 4/1994 | Nebb | 4/516 |
| 5,465,438 | 11/1995 | Allman | 4/626 |
| 5,649,557 | 7/1997 | Usher . | |
| 5,702,115 | 12/1997 | Pool | 280/47.35 |
| 5,704,078 | 1/1998 | Chandler | 4/449 |
| 5,813,063 | 9/1998 | Watkins | 4/626 |

*Primary Examiner*—Frankie L. Stinson
*Assistant Examiner*—Mialeeka C. Williams-Bibbs
*Attorney, Agent, or Firm*—Brooks & Kushman P.C.

[57] ABSTRACT

A parts washer unit including an aqueous cleaning fluid storage receptacle which can be easily exchanged with a like receptacle by the user of the unit. The unit includes a injection molded plastic base for supporting the receptacle and a sink. The base includes an upper portion configured to support the sink from a fixed work surface, and a lower portion configured to receive the receptacle. The lower portion includes side walls to cammingly guide the receptacle in a lateral direction and a bottom wall configured with an inclined cam surface leading to a generally horizontal receptacle support surface to cammingly guide the receptacle in a longitudinal direction. The bottom wall contains channels that form ribs sufficiently spaced to provide structural rigidity and minimize heat transfer from the receptacle to the fixed work surface.

8 Claims, 3 Drawing Sheets

Fig. 3
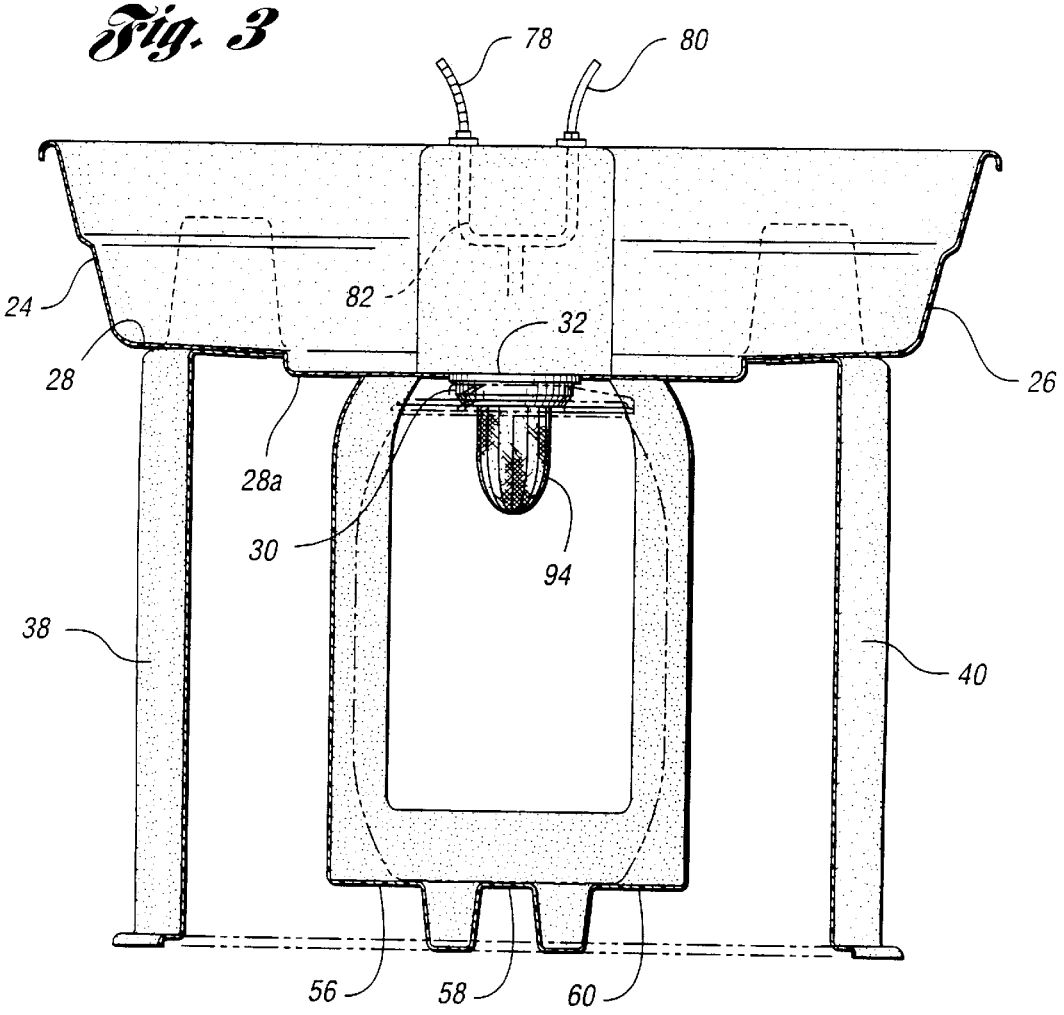
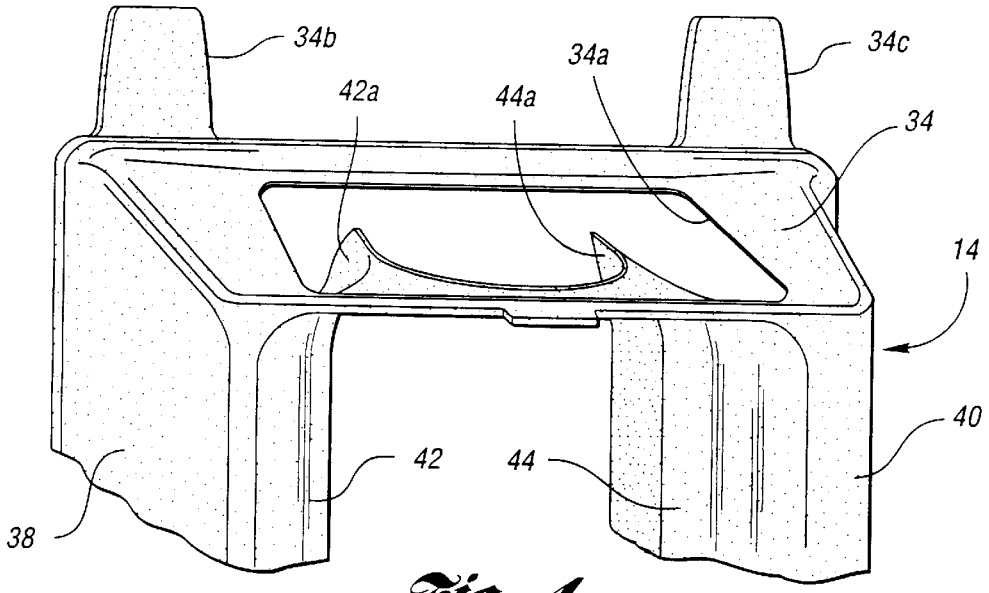
Fig. 4

PARTS WASHING APPARATUS

TECHNICAL FIELD

This invention relates to parts washing apparatus and more particularly to a parts washer that is economical and readily serviceable by the end user.

BACKGROUND ART

Parts washers or cleaners have been used by mechanics at auto dealerships, garages and other places of business for many years. In U.S. Pat. No. 5,649,557 assigned to the assignee of the present invention, a parts washer is disclosed that includes a sink mounted to an independent support structure that is adapted to receive and support a fluid storage receptacle. The sink support structure includes a roller conveyor that supports the receptacle and permits an old receptacle to be easily replaced with a new receptacle without removing the sink during servicing of the washer. The parts washer has a fluid circulating system that includes a submersible electric pump located in the fluid receptacle for circulating cleaning fluid between the receptacle and the sink. The cleaning fluid is preferably an aqueous solution and a heating unit is provided to elevate the temperature of the solution to improve its cleaning capabilities.

The roller conveyor proposed in the aforementioned patent adds cost to the unit and requires maintenance over time. Accordingly, it would be advantageous to eliminate the conveyor while maintaining ease of replacement of the fluid receptacle. An aqueous cleaning solution is advantageous relative to petroleum based cleaning solutions but to be most effective must be maintained at an elevated temperature by the heating unit. It would be advantageous from a cost standpoint to minimize heat loss from the cleaning fluid.

SUMMARY OF THE INVENTION

In accordance with the present invention a readily serviceable parts washer is provided that includes an injection molded base, adapted to rest on a fixed work surface or floor. The base supports a cleaning solution storage receptacle in heat transfer relationship therewith and also supports a sink having an opening intended to be aligned with an opening in the receptacle.

The base comprises an upper portion adapted to support the sink above the fixed surface, and a lower portion adapted to receive and support the receptacle. The lower portion is configured with a bottom wall and side walls having inclined surfaces to cammingly guide the receptacle in both a lateral and a longitudinal direction in order to assist the service person in replacing the fluid receptacle and aligning an opening in the receptacle cover for fluid communication with the drain opening in the sink. The bottom wall comprises an inclined surface that assists the user in elevating the receptacle to an integrally formed generally horizontal surface upon which the receptacle is finally located. The bottom wall comprises ribs which create an air space to minimize heat transfer from the receptacle to the floor on which the molded support structure rests. The liquid in the receptacle is circulated and temperature controlled by a pump and heater that are configured to form an integral assembly with the cover of the receptacle.

BRIEF DESCRIPTION OF THE DRAWINGS

FIG. 3 is a vertical cross-sectional of the parts washer;

FIG. 4 is a perspective view of the parts washer base showing the upper portion for supporting the sink;

DETAILED DESCRIPTION OF PREFERRED EMBODIMENT

Figure 1:
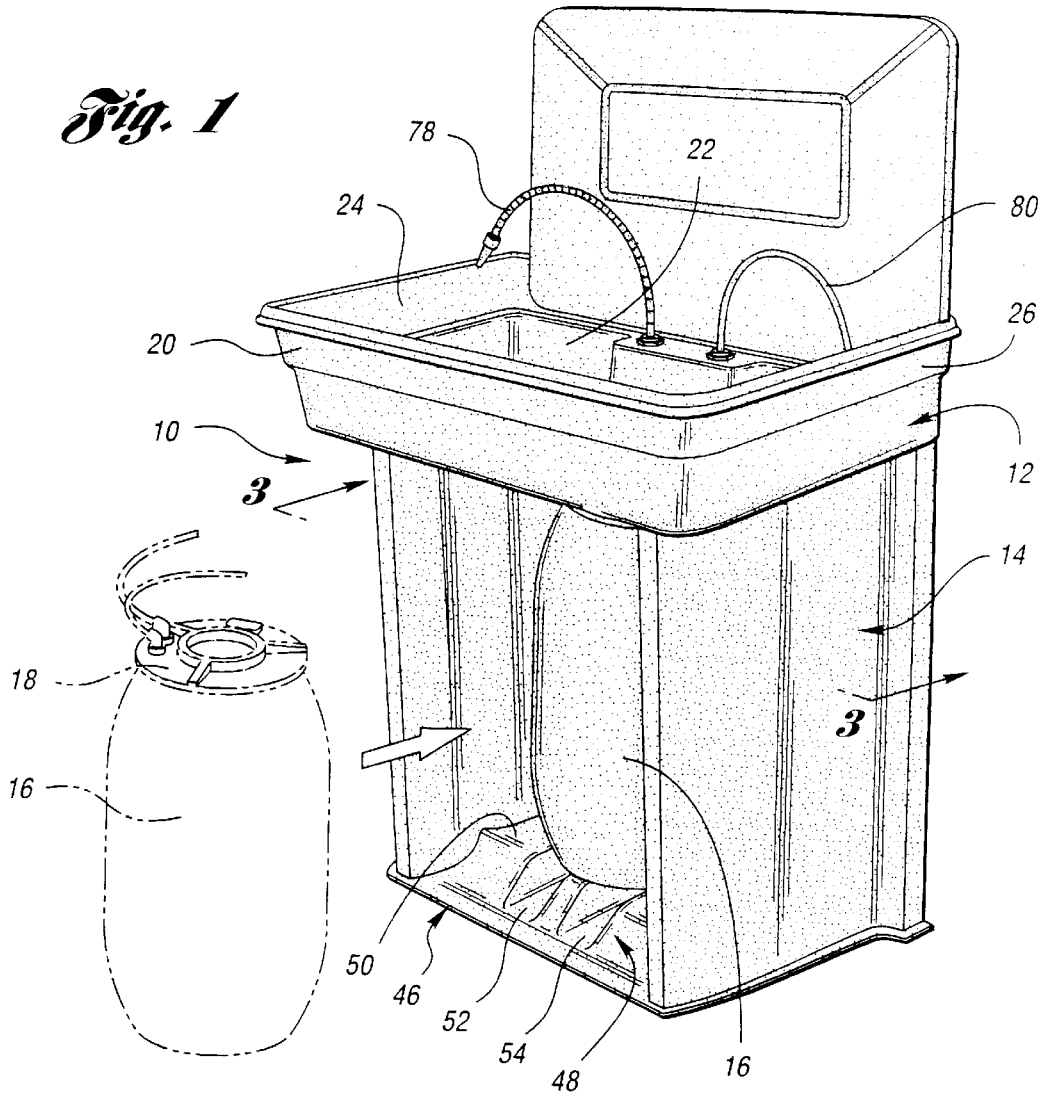
FIG. 1 is a perspective view of the parts washer of the present invention.
Figure 2:
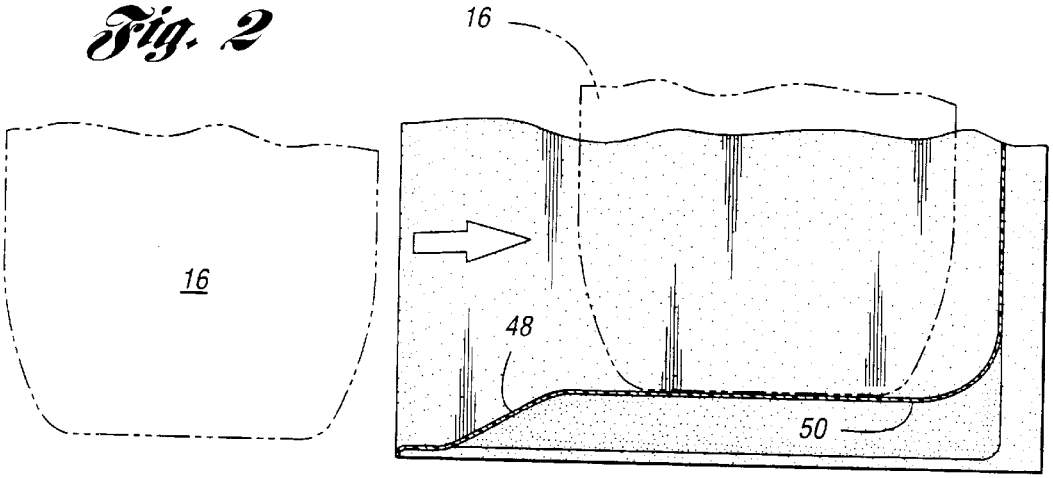
FIG. 2 is side elevation view of a portion of the parts washer base showing the lower portion for supporting the fluid receptacle.

Referring now to the drawings, and initially to FIG. 1, the parts washing apparatus of the present invention is generally designated 10 and includes a molded polyethylene sink 12 for holding parts to be cleaned. The sink 12 is supported by a molded polyethylene base generally designated 14 which also supports a general barrel shaped molded polyethylene clearing fluid receptacle 16. The solution for cleaning the parts is stored in the receptacle 16 and circulated by a pump assembly secured to the receptacle cover generally designated 18. The cleaning solution is preferably a water based alkaline detergent or similar biodegradable washing solution and is maintained at a higher than ambient temperature by a heater assembly, secured to the cover 18, and suitable control circuitry.

With reference to FIGS. 3 and 4, the sink 12 includes front and rear walls 20 and 22, side walls 24 and 26 and a bottom wall 28 forming an enclosure for receiving and holding the parts to be cleaned. The sink 12 has a generally rectangular shaped sump area, generally designated 28*a* integrally formed in the bottom wall 28. The sump 28*a* has a centrally located, integral, cylindrical, portion forming a sink drain and splash guard 30 with a drain opening 32. The sink 12 is supported on the base 14 which is intended to rest on a work surface, not shown. The base 14 includes an upper portion 34 for supporting the sink above the work surface. The upper portion 34 is provided with a generally rectangular opening 34*a* adapted to receive the sump area 28*a* of the sink and further includes upstanding tabs 34*b* and 34*c* to assist in positioning the sink on the upper portion of the base while permitting the sink to be tilted upwardly during replacement of a fluid receptacle.

The base further includes a lower portion comprising upstanding side walls 38 and 40 and having inwardly angled entrance surfaces 42 and 44 that cammingly guide the receptacle laterally into position to allow fluid from the sink to flow through the sink drain 30 into the receptacle 16. The surfaces 42 and 44 include respective extensions 42*a* and 44*a* that partially surround the receptacle when positioned beneath the sink. The base 14 further includes a bottom wall generally designated 46 that includes an inclined surface 48 to cammingly guide the receptacle longitudinally onto a generally horizontal platform or support surface 50 where the receptacle can be moved into position with the drain opening. The bottom wall 46 is configured with spaced apart channels 52 and 54 that form ribs 56, 58 and 60 to provide structural rigidity to the bottom wall to support the fluid filled receptacle on the raised surface 50. The ribs 56–60 in the bottom wall also create an air space in the channels 52 and 54 and between the support surface 50 and the work surface or floor supporting the washer 10. This air space minimizes heat transfer between the cleaning fluid in the receptacle 16 and the work surface.

Figure 5:
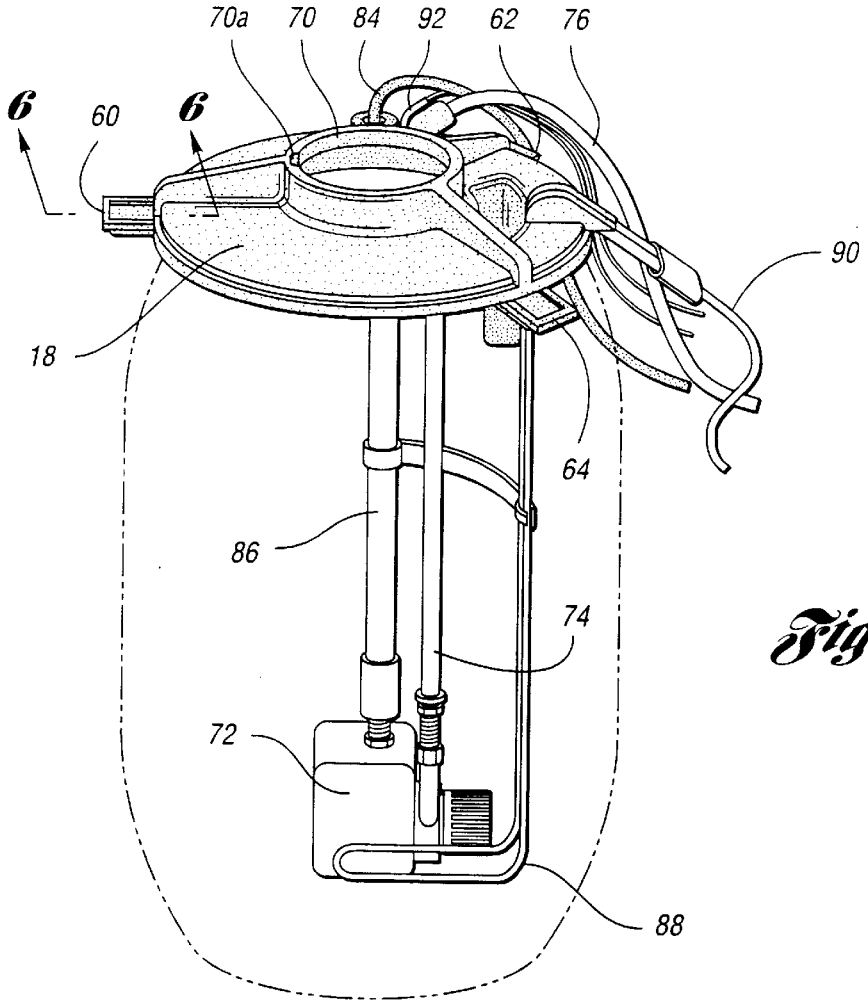
FIG. 5 is a perspective view of receptacle cover with the pump and heater assemblies attached.
Figure 6:
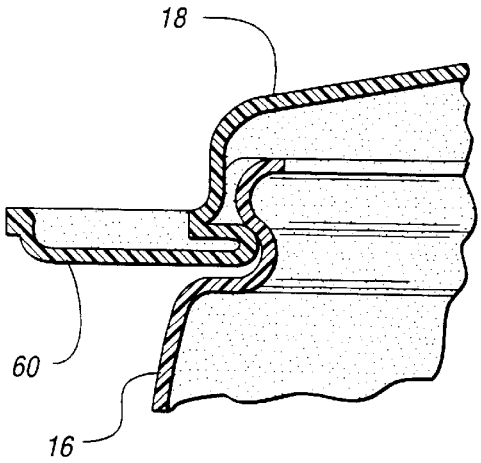
FIGS. 6 and 7 are partial cross-sectional views of the receptacle taken along lines 6—6 of FIG. 5, showing the manner in which the cover is secured to the receptacle body.
Figure 7:
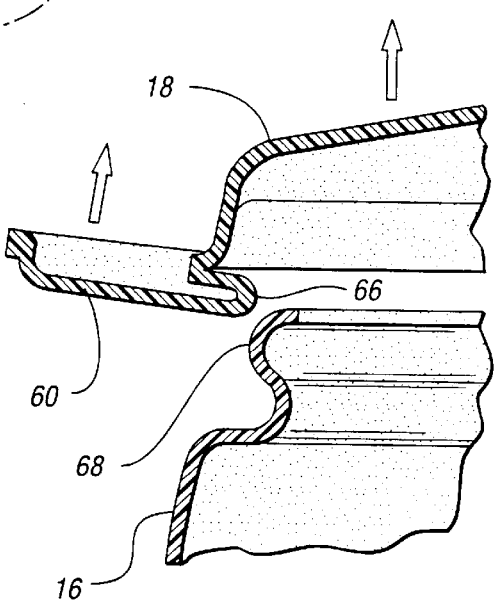

Referring now to FIG. 5–7, the cover 18 for the receptacle 16 is formed of molded polyethylene material and includes three integral circumferentially spaced ears 60–64. A lip 66 of the cover 18 snaps over a mating circular protrusion 68 on the receptacle to hold the cover in place. The cover 18 has a central opening 70 that receives the splash guard 30. A key is formed on the splash guard 30 and fits in a slot 70*a* formed in the opening 70, when the receptacle is in place beneath the sink 12 to assist in correctly positioning the receptacle. While the splash guard 30 is in place, heat loss from the solution in the receptacle is minimized, as is splatter from fluid returning to the receptacle from the sink.

The cover 18 supports a system for circulating fluid between the receptacle 16 and the sink 12. The system includes a submersible pump and electric motor unit 72. The unit 72 has a polyethylene pipe 74 attached to a pump outlet port at one end and coupled with a flexible outlet tube 76 at the other end, to supply fluid to hoses 78 and 80 (FIG. 1) through a suitable splitter 82. Preferably, the hoses 78 and 80 include respective manually operated valves for controlling the flow of fluid. The hoses 78 and 80 may be respectively coupled to a nozzle and a brush end to deliver solution to the parts located in the sink 12 under hand control of the user. The motor of the pump unit 72 is suitably connected to a power outlet through an electrical conductor 84. The conductor 84 is shielded from the solution by a cylindrical hollow conduit 86. The conduit 86 is suitably secured to the pump housing and the cover 18.

A heating element 88 is fastened to the cover 18 and spaced from the unit 72 by a bracket 90. The heating element 88 is electrically connected to power through a conductor 90. The heat sensor generally designated 92 is supported by the cover 18 and is eclectically connected by with temperature control circuitry (not shown). The circuitry controls the element 88 to maintain a relatively constant solution temperature elevated sufficiently to improve the cleaning ability of the solution.

A sock strainer 94 seats in the drain opening in the sink and extends through the splash guard and into the receptacle 16 as shown in FIG. 3. The strainer serves as a filter by collecting relatively large particles that are removed from the parts during the cleaning process. Further details of a suitable strainer may be found in the aforementioned patent.

When servicing is required, the strainer 94 is removed from the sink 12 and the sink is tilted to permit removal of the receptacle containing the contaminated fluid. The receptacle is moved down the inclined surface 48 and removed from the space created by the base 14. The cover 18 with the attached pump and heater assemblies are removed by flexing one or more of the ears 60–64 to release the cover 18 from the receptacle 16 as shown in FIGS. 6 and 7. The cover 18 with pump and heater assemblies is then placed in a new receptacle with clean fluid. The sink 12 is tilted upwardly and the new receptacle 16 is pushed up the inclined camming surface 48 by the user and onto the surface 50. The receptacle is guided rearwardly by the side walls of the base 14 until positioned in the space vacated by the old receptacle. The sink is then lowered and the splash guard is received by the central opening in the cover 18.

It will be understood that the above description of the preferred embodiment is by way of example only and that various modifications are possible without departing from the spirit and the scope of the present invention as hereinafter claimed.

What is claimed is:

1. An injection molded base for a parts washer for supporting an aqueous cleaning solution storage receptacle from a fixed work surface, said base comprising:

a pair of side walls and a bottom wall;

said bottom wall comprising an inclined surface for guiding the receptacle in a longitudinal direction to a substantially horizontal platform surface that supports said receptacle, said bottom wall including ribs sufficiently spaced from each other to provide structural rigidity to the bottom wall and establish an air space to minimize heat transfer between the receptacle and said fixed work surface.

2. The base defined in claim 1 wherein said air space established by said ribs extends between the ribs as well as between the horizontal platform surface and fixed work surface.

3. The base defined in claim 2 wherein said side walls comprise respective inwardly angled entrance surfaces for assisting in the lateral placement of said receptacle on said platform surface.

4. The base defined in claim 3 further comprising a top wall for supporting a sink, said top wall including an opening for receiving a portion of said sink for substantially restricting lateral and longitudinal motion while permitting a tilting motion.

5. A parts washer comprising an injection molded base for supporting a sink and an aqueous cleaning solution storage receptacle from a fixed work surface, said base comprising:

a top wall, a pair of side walls and a bottom wall;

said top wall configured to receive at least a portion of the sink;

said bottom wall comprising an inclined cam surface for guiding the receptacle in a longitudinal direction to a substantially horizontal platform surface that supports said receptacle beneath said sink, said side walls comprising respective inwardly directing cam surfaces for assisting in the lateral placement of said receptacle beneath an opening in said sink, said bottom wall including a pair of channels forming ribs sufficiently spaced from each other and from said fixed work surface to provide structural rigidity to the bottom wall and establish an air space to minimize heat transfer between the receptacle and said fixed work surface.

6. The parts washer of claim 5 wherein said storage receptacle is open at one end and includes a cover supporting a pump and heater assembly for heating and circulating an aqueous cleaning solution, said cover including a lip and integral flexible ears for removably securing the cover with a mating circular protrusion at the open end of said receptacle.

7. A parts washer comprising an injection molded base for supporting a receptacle in heat transfer relationship therewith and for supporting a sink, having an opening in lateral and longitudinal communication with the receptacle, said base comprising:

a first portion configured to support the sink from a fixed surface;

a second portion configured to receive the receptacle and to canmningly guide the receptacle into communication with the drain opening in a lateral direction when the receptacle is received, and a third portion configured to cammingly guide the receptacle into communication with the drain opening in a longitudinal direction when the receptacle is received, the configuration of said third portion including sufficiently spaced ribs to minimize the heat transfer relationship of said base and receptacle.

8. The parts washer defined in claim 7, wherein said second portion includes extensions that at least partially enclosing said receptacle when in position beneath said sink.

* * * * *